US012605606B2

(12) United States Patent
Lee et al.

(10) Patent No.: US 12,605,606 B2
(45) Date of Patent: Apr. 21, 2026

(54) GOLF SWING PLATFORM AND CONTROL METHOD FOR THE SAME

(71) Applicant: GOLFZON CO., LTD., Seoul (KR)

(72) Inventors: Jung Hun Lee, Sejong-si (KR); Gwang Seok Jeon, Daejeon (KR)

(73) Assignee: GOLFZON CO., LTD., Seoul (KR)

( * ) Notice: Subject to any disclaimer, the term of this patent is extended or adjusted under 35 U.S.C. 154(b) by 813 days.

(21) Appl. No.: 17/802,520

(22) PCT Filed: Mar. 9, 2021

(86) PCT No.: PCT/KR2021/002908
§ 371 (c)(1),
(2) Date: Aug. 25, 2022

(87) PCT Pub. No.: WO2021/182844
PCT Pub. Date: Sep. 16, 2021

(65) Prior Publication Data
US 2023/0087604 A1 Mar. 23, 2023

(30) Foreign Application Priority Data
Mar. 11, 2020 (KR) ..... 10-2020-0030273

(51) Int. Cl.
*A63B 67/02* (2006.01)
*A63B 69/36* (2006.01)
(Continued)

(52) U.S. Cl.
CPC ..... *A63B 67/02* (2013.01); *A63B 69/3661* (2013.01); *A63B 71/0622* (2013.01);
(Continued)

(58) Field of Classification Search
None
See application file for complete search history.

(56) References Cited

U.S. PATENT DOCUMENTS 5,386,997 A * 2/1995 Smith ..... A63B 69/0079 473/190
5,763,761 A * 6/1998 Parente ..... A63B 60/42 73/12.02
(Continued)

FOREIGN PATENT DOCUMENTS

JP 2001-145717 A 5/2001
JP 2014-508624 A 4/2014
(Continued)

OTHER PUBLICATIONS

International Search Report for PCT/KR2021/002908 mailed Jun. 21, 2021 from Korean Intellectual Property Office.

*Primary Examiner* — Eugene L Kim
(74) *Attorney, Agent, or Firm* — Revolution IP, PLLC

(57) ABSTRACT

The present invention relates to a golf swing platform linked to a virtual golf course, and may independently drive a swing-stage part and a hitting part of the platform, and the inclination information may be calculated from terrain information of an area corresponding to the swing-stage part and the hitting part of the platform based on a position where a virtual ball is placed on the virtual golf course, and the swing-stage part and the hitting part may be controlled to be driven, respectively.

11 Claims, 9 Drawing Sheets

(51) Int. Cl.
*A63B 71/06* (2006.01)
*A63B 24/00* (2006.01)

(52) U.S. Cl.
CPC ..... *A63B 2024/0096* (2013.01); *A63B 2071/0647* (2013.01); *A63B 2220/18* (2013.01)

(56) References Cited

U.S. PATENT DOCUMENTS 5,820,478 A * 10/1998 Wood ..... A63B 69/3652 473/279
2014/0004967 A1 1/2014 Jang et al.

FOREIGN PATENT DOCUMENTS

KR 10-0912015 B1 8/2009
KR 10-2010-0123528 A 11/2010
KR 10-2011-0058580 A 6/2011
KR 10-1422073 B1 7/2014
KR 10-2015-0132951 A 11/2015
KR 10-1677911 B1 11/2016

* cited by examiner (a)

(b)

GOLF SWING PLATFORM AND CONTROL METHOD FOR THE SAME

TECHNICAL FIELD

The present invention relates to a golf swing platform on which a user performs a golf swing with a golf club in golf practice or screen golf using a virtual golf simulation device, and a control method for realizing the terrain of the golf swing platform.

BACKGROUND ART

Generally, in golf courses, users may simply take golf shots on flat ground, but they often take golf shots under various topographical conditions such as downhill slopes, uphill slopes, gentle slopes, steep slopes, and recessed terrain.

In this way, a swing plate is provided as a batter's box for the user to take a golf shot in various terrain conditions as well as a golf shot on flat ground. The swing plate forms an inclination at an arbitrary angle, and the user takes a golf shot on the inclined swing plate so that the user can practice golf shot under various topographic conditions.

The conventional swing plate as described above has a configuration in which a single plate member may be inclined at various angles by a motor.

As a prior art document related to this, prior art such as Korean Patent No. 0912015 and Korean Patent No. 1422073 are disclosed.

However, the swing plate, which simply tilts a single plate member in one direction, has a limit in allowing the user to practice golf shots under various terrain conditions. In addition, since the golf mat portion on which the ball is placed and hit is provided on one side of a single plate member, that is, the portion where the user stands for the golf swing and the golf mat portion on which the ball is placed move simultaneously on one swing plate. However, the realization of the terrain of the swing plate was significantly different from the terrain on the virtual golf course, and there was a limit in reality to the golf shot.

DISCLOSURE

Technical Problem

The present invention relates to a golf swing platform linked to a virtual golf course, and may independently drive a swing-stage part and a hitting part of the platform. The inclination information may be calculated from terrain information of an area corresponding to the swing-stage part and the hitting part of the platform based on a position where a virtual ball is placed on the virtual golf course, and the swing-stage part and the hitting part may be controlled to be driven, respectively. Accordingly, the golf swing platform for improving a sense of reality of a golf shot environment and a control method thereof may be provided by enabling more various terrain conditions on the virtual golf course to be implemented, which is difficult to implement a conventional swing plate.

Technical Solution

In accordance with an aspect of the present invention, the above and other objects can be accomplished by the provision of a golf swing platform on which a user takes a golf swing with a golf club, comprising: a lower supporter including a stage supporter and a hitting supporter; a hitting stage which is provided on the hitting supporter of the lower supporter so that a golf ball is placed for the user's golf shot and implements an inclination based on terrain information: a swing stage which is provided on the stage supporter of the lower supporter and implements an inclination with the hitting stage based on the terrain information: a stage-terrain realization driver which is provided between the swing stage and the stage supporter, and drives the swing stage to implement an inclination; a hitting-terrain realization driver which is provided between the hitting stage and the hitting supporter, and drives the swing stage to implement an inclination; and a controller which calculates inclination information of the swing stage from terrain information of an area corresponding to the swing stage and calculates inclination information of the hitting stage from terrain information of an area corresponding to the hitting stage based on a position where a virtual ball is placed on a virtual golf course so that the stage-terrain realization driver and the hitting-terrain realization driver are independently controlled.

Preferably, the swing stage includes a plurality of divided plates each implementing inclination based on the terrain information so that the swing stage implements complex inclinations corresponding to the terrain information.

Preferably, the swing stage includes a rotating-support hub provided in the central portion of the swing-stage and supporting each end of the plurality of divided plates to be rotatable in relation to the two-axis direction, wherein the plurality of divided plates are divided around the rotating-support hub so that each of the divided plates is configured to implement an inclination.

Preferably, the hitting-terrain realization driver is configured to drive to implement an inclination of the hitting stage in a direction perpendicular to the horizontal axis and an inclination of the hitting stage in a direction perpendicular to the vertical axis, and drive the hitting stage to be shifted toward the swing stage.

Preferably, the hitting-terrain realization driver includes a plurality of actuators, wherein each of the three vertex positions forming a triangle on the hitting stage is an action point, the ends of the two actuators are coupled to each action point, and each of the other ends of the two actuators is coupled to positions spaced apart from each other on the hitting supporter, and wherein each of the action points on the hitting stage is triangularly supported with respect to the hitting supporter by combinations of the actuators, and the implementation of the inclinations of the hitting stage is performed based on each operating point.

Preferably, the controller is configured to control implementation of a simulation image in which the virtual ball moves on the virtual golf course based on sensing information of the sensing device for the golf ball hit by the user, and wherein a position of the golf ball on the hitting stage sensed by the sensing device corresponds to a position of the virtual ball on the virtual golf course, and an area on the virtual golf course corresponding to an area of the swing stage and the hitting stage is specified based on the position of the virtual ball.

Preferably, the controller is configured to set the position of the virtual ball on the virtual golf course as an origin based on which the controller specifies a hitting stage corresponding area that is an area corresponding to the hitting stage, wherein the controller is configured to set a position by a predetermined distance on the virtual golf course based on the position of the virtual ball as an origin based on which the controller specifies a swing stage corresponding area that is an area corresponding to the swing stage, and wherein the controller is configured to calculate the inclination in the horizontal direction and the inclination in the vertical direction based on each of the set origin points, and control the inclinations of the hitting stage and the swing stage according to the calculated inclination in each of the two directions.

Preferably, the swing stage is configured to be divided into a plurality of divided plates each of which is provided to implement a predetermined inclination, wherein the controller is configured to specify a swing stage corresponding area that is an area corresponding to the swing stage based on the position of the virtual ball in the virtual golf course, and calculate an inclination toward a left direction in a horizontal axis, an inclination toward a right direction in the horizontal axis, an inclination forward in a vertical axis and an inclination backward in the vertical axis based on an origin set on the swing stage corresponding area, and wherein the controller is configured to control the inclination of the swing stage by driving a height between adjacent divided plates among the plurality of divided plates to correspond to the inclination toward the left direction in the horizontal axis.

In accordance with an aspect of the present invention, the above and other objects can be accomplished by the provision of a control method of a golf swing platform comprising: providing an image of a virtual golf course by a client: specifying areas on the virtual golf course corresponding to a swing stage on which a user stands for a golf swing and a hitting stage on which a golf ball is placed for the user's golf shot based on a position of a virtual ball on the virtual golf course: calculating inclination information of the swing stage and inclination information of the hitting stage from terrain information of the specified area corresponding to the swing stage and the specified area corresponding to the hitting stage: controlling a hitting-terrain realization driver to drive the hitting stage so as to implement an inclination of the hitting stage according to the calculated information; and controlling a stage-terrain realization driver to drive the swing stage so as to implement an inclination of the swing stage according to the calculated information.

Preferably, the specifying areas on the virtual golf course includes specifying a hitting stage corresponding area that is the area corresponding to the hitting stage based on the position of the virtual ball in the virtual golf course, wherein the calculating inclination information includes calculating a first inclination of the hitting stage that is an inclination in a direction of a horizontal axis and a second inclination of the hitting stage that is an inclination in a direction of a vertical axis based on the position of the virtual ball as an origin, and wherein the controlling the hitting-terrain realization driver includes controlling the hitting-terrain realization driver so that the inclination of the hitting stage is adjusted according to the calculated the first and the second inclinations of the hitting stage.

Preferably, the swing stage is configured to be divided into a plurality of divided plates each of which is provided to implement an inclination according to terrain information so that the swing stage enables to implement complex inclinations, wherein the specifying areas on the virtual golf course includes specifying a swing stage corresponding area that is the area corresponding to the swing stage based on the position of the virtual ball in the virtual golf course, wherein the calculating inclination information includes calculating a first inclination of the swing stage that is an inclination of a backward direction in a vertical axis, a second inclination of the swing stage that is an inclination in a right direction of a horizontal axis, a third inclination of the swing stage that is an inclination in a left direction of the horizontal axis and a fourth inclination of the swing stage that is an inclination of a forward direction in the vertical axis based on a center point of the swing stage corresponding area as an origin, and wherein the controlling the stage-terrain realization driver includes controlling the stage-terrain realization driver so that the inclination of each of the divided plates of the swing stage is adjusted according to the calculated the first, the second, the third and the fourth inclinations of the swing stage.

Preferably, the controlling the hitting-terrain realization driver includes: determining to generate a predetermined gap between the swing stage and the hitting stage according to information calculated in step calculating inclination information of the swing stage and inclination information of the hitting stage; and controlling the hitting-terrain realization driver so that the hitting stage shifts toward the swing stage when the predetermined gap between the swing stage and the hitting stage is generated.

Advantageous Effects

The golf swing platform and control method for the same according to the present invention may have advantageous effects by means of that the plurality of divided plates may form one swing-stage while separating the hitting part in which the golf ball is placed from the swing-stage part to independently drive the divided plates and the hitting part. Accordingly, it is possible to implement more various terrain that is difficult to implement a conventional swing plate, and to improve a sense of reality about a golf shot environment by implementing a terrain condition on the virtual golf course.

BEST MODE

A golf swing platform according to the present invention will be more specifically described with reference to the drawings.

Figure 1:
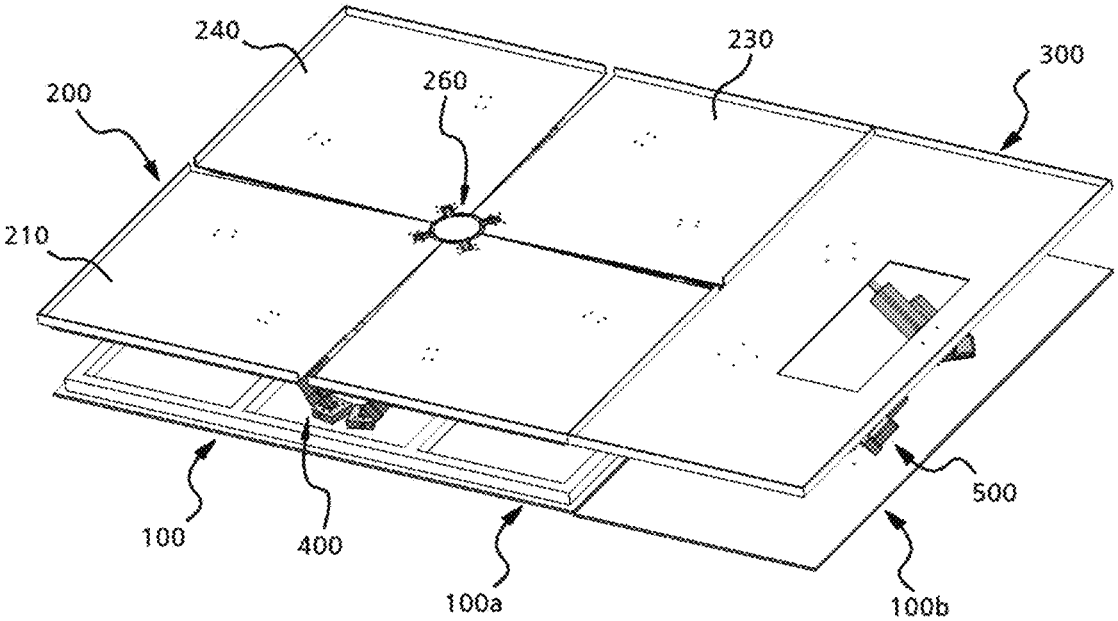
FIG. 1 is a perspective view of a golf swing platform according to an embodiment of the present invention.

First, the configurations of the golf swing platform according to an embodiment of the present invention will be described with reference to FIG. 1. FIG. 1 is a perspective view of the golf swing platform according to an embodiment of the present invention.

As shown in FIG. 1, a golf swing platform according to an embodiment of the present invention is provided with a part that forms a swing-stage allowing a user to swing a golf and a part where a golf ball is placed and hit by a user's golf swing is separated. The golf swing platform includes a lower supporter 100, a swing stage 200, a hitting stage 300, a stage-terrain realization driver 400, a hitting-terrain realization driver 500, and a controller (not shown).

The lower supporter 100 is an element for supporting device at the lower end of the golf swing platform according to an embodiment of the present invention. The lower supporter 100 may be divided into a stage supporter 100*a* supporting the swing stage 200 and a hitting supporter 100*b* supporting the hitting stage 300. The stage-terrain realization driver 400 is installed in the stage supporter 100*a*, and the hitting-terrain realization driver 500 is installed in the hitting supporter 100*b*.

The swing stage 200 is installed on the stage-terrain realization driver 400 on the stage supporter 100*a* of the lower supporter 100 to form a user-standing stage, and to implement an inclination based on terrain information (for example, terrain information of a virtual golf course implemented as an image of a virtual golf simulation system). The swing stage 200 may be formed of a single plate member, and may be formed of a plurality of divided plates each of which implements an inclination. The swing stage 200 may include a plurality of divided plates having different sizes, and the swing stage 200 may include four divided plates 210 to 240 as shown in FIG. 1.

Various embodiments may be possible in configuring the swing stage 200 as described above, however hereinafter, the swing stage 200 including a plurality of divided plates in which the entire plate is divided into four equal plates will be described as an embodiment.

As shown in FIG. 1, the first divided plate 210, the second divided plate 220, the third divided plate 230 and the fourth divided plate 240 provided by dividing the entire swing-stage into quarters are implemented as the plurality of divided plates, and all of the plurality of divided plates 210~240 may form the swing-stage 200.

The rotating support hub 260 is provided at the center of the swing-stage 200 to rotatably support the ends of each of the plurality of the divided plates 210 to 240.

Although not illustrated in the drawings, the rotating support hub 260 can be driven in a vertical direction by a hub driver (not illustrated) that drives in a vertical direction.

The hitting stage 300 is provided on the hitting supporter 100*b* of the lower supporter 100, and a golf ball is placed for a golf swing, and the golf ball is hit by the user's golf club. The hitting stage 300 is also configured to implement an inclination based on terrain information.

The stage-terrain realization driver 400 is fixedly installed between the stage supporter 100*a* and the swing stage 200, and each of the divided plates 210 to 240 of the swing stage 200 is driven to realize a predetermined inclination, thereby allowing the swing stage 200 to realize a predetermined terrain.

The hitting-terrain realization driver 500 is fixedly installed between the hitting supporter 100*b* and the hitting stage 300, and drives the hitting stage 300 to realize a predetermined inclination.

The controller may control the stage-terrain realization driver 400, the hub driver (not shown), and the hitting-terrain realization driver 500 to implement the inclination of each of the divided plates 210 to 240 of the swing stage 200 and the inclination of the hitting stage 300. That is, the controller may calculate a control value for controlling each driver from terrain information of a virtual golf course to be implemented through a client, e.g., a computer of a virtual golf simulation apparatus such as a screen golf system, and transmit the same to each driver. Alternatively, when the client calculates a control value, the controller may receive the control value and transmit the control value to each driver so that each driver is controlled. Accordingly, the golf swing platform may implement complex inclinations close to terrain information around the position where the virtual ball is placed on the virtual golf course.

A detailed control method for implementing the terrain of the divided swing stage and the hitting stage by the client and the controller will be described later.

The features of the present invention as described above will be described in more detail with reference to FIGS. 2 to 4.

Figure 2:
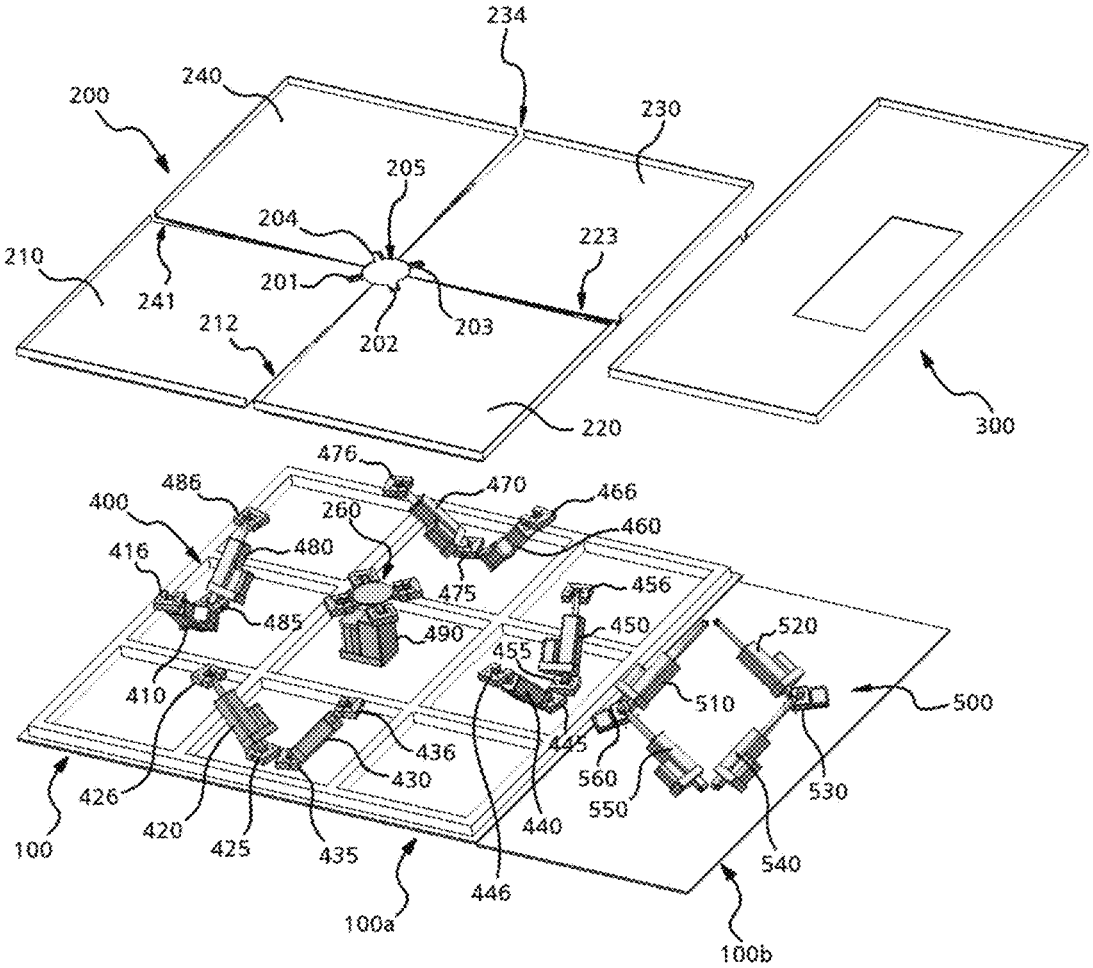
FIG. 2 is a perspective view showing a divided swing-stage and a hitting-stage separated from a lower supporter of the golf swing platform according to an embodiment of the present invention.

FIG. 2 is a perspective view showing the swing stage and the hitting stage separated from a lower supporter of the golf swing platform according to an embodiment of the present invention. FIG. 3 is a top view showing the lower supporter and a stage-terrain realization driver shown in FIG. 2. FIG. 4 is a view showing a driving actuator and a rotating-support hub of the stage-terrain realization driver shown in FIG. 2.

Figure 3:
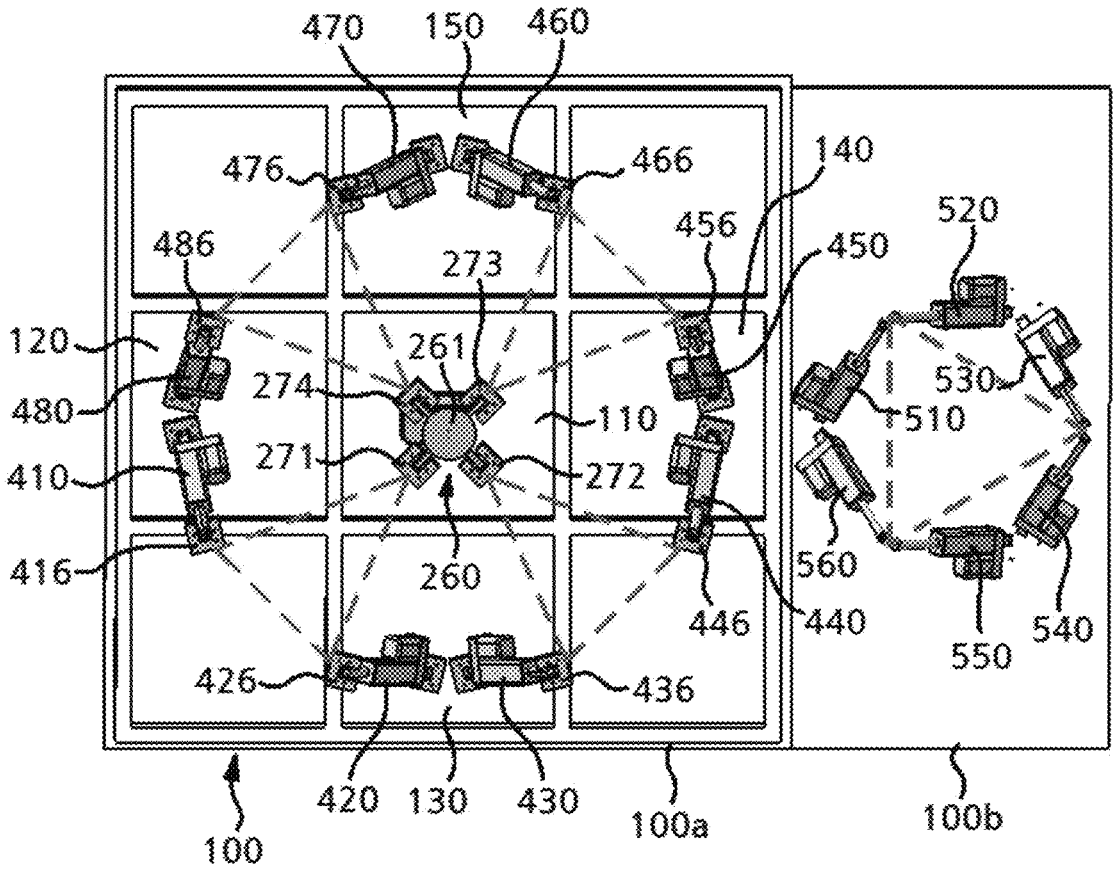
FIG. 3 is a top view showing the lower supporter, a stage-terrain realization driver and a hitting-terrain realization driver shown in FIG. 2.

As shown in FIGS. 2 and 3, the rotating support hub 260 is provided at the center of the stage supporter 100*a* of the lower supporter 100, and the hub driver 490 for vertically driving the rotating support hub 260 is provided at the center of the stage supporter 100*a*. A plurality of driving actuators 410 to 480 may be installed around the rotating support hub 300.

The rotating support hub 260 allows each of the divided plates 210 to 240 of the swing stage 200 to rotate while fixedly supporting each of the divided plates 210 to 240 at the center of the swing stage 200 (the rotations of each of the divided plates includes rotation in the uniaxial direction as well as rotation in the biaxial direction, which will be described below).

The plurality of driving actuators, as shown in FIGS. 2 and 3, may include a first driving actuator 410, a second driving actuator 420, a third driving actuator 430, a fourth driving actuator 440, a fifth driving actuator 450, a sixth driving actuator 460, a seventh driving actuator 470 and an eighth driving actuator 480.

Each of the driving actuators 410 to 480 may have a lower fixing member at its lower end. As shown in FIGS. 2 and 3, a first lower fixing member (not shown) may be provided at the lower end of the first driving actuator 410, a second lower fixing member 425 may be provided at the lower end of the second driving actuator 420, a third lower fixing member 435 may be provided at the lower end of the third driving actuator 430, a fourth lower fixing member 445 may be provided at the lower end of the fourth driving actuator 440, a fifth lower fixing member 455 may be provided at the lower end of the fifth driving actuator 450, a sixth lower fixing member 465 may be provided at the lower end of the sixth driving actuator 460, a seventh lower fixing member 475 may be provided at the lower end of the seventh driving actuator 470, and a eighth lower fixing member 485 may be provided at the lower end of the eighth driving actuator 480.

Each of the lower fixing members 425 to 485 as stated above allows each of the corresponding driving actuators 410 to 480 to be rotatable while allowing each of the corresponding driving actuators 410 to 480 to be fixed on the stage supporter 100*a*.

Meanwhile, each of the driving actuators 410 to 480 may have an upper fixing member on its upper end. As shown in FIGS. 2 and 3, a first upper fixing member 416 may be provided at the upper end of the first driving actuator 410, a second upper fixing member 426 may be provided at the upper end of the second driving actuator 420, a third upper fixing member 436 may be provided at the upper end of the third driving actuator 430, a fourth upper fixing member 446 may be provided at the upper end of the fourth driving actuator 440, a fifth upper fixing member 456 may be provided at the upper end of the fifth driving actuator 450, a sixth upper fixing member 466 may be provided at the upper end of the sixth driving actuator 460, a seventh upper fixing member 476 may be provided at the upper end of the seventh driving actuator 470, and an eighth upper fixing member 486 may be provided at the upper end of the eighth driving actuator 480.

Each of the upper fixing members 416 to 486 as stated above allows each of the corresponding driving actuators 410 to 480 to be rotatable while allowing each of the corresponding driving actuators 410 to 480 to be fixed on each of the divided plates 201 to 240 of the swing stage 200.

However, as shown in FIGS. 2 and 3, each of the driving actuators 410 to 480 is fixed and driven in an oblique posture inclined in a predetermined angle from the lower fixing member to the upper fixing member, and the two driving actuators are fixed to one divided plate so that the inclination of the divided plate to be implemented by the two driving actuators.

And, as shown in FIG. 2, each of the divided plates 210 to 240 of the swing stage 200 may include each of grooves 201 to 204 in the center thereof. The plurality of divided plates 210 to 240 form one installation hole 205, and the rotating support hub 260 is installed in the installation hole 205.

As shown in FIG. 3, the rotating support hub 260 may be configured to include a hub shaft 261 in the center and rotating-support part 271 to 274 corresponding to each of the plurality of divided plates 210 to 240 on the hub shaft 261.

That is, as shown in FIGS. 2 and 3, the first rotating-support part 271 of the rotating support hub 260 may be fixed to the side of the first groove 201 of the first divided plate 210, the second rotating-support part 272 of the rotating support hub 260 may be fixed to the side of the second groove 202 of the second divided plate 220, the third rotating-support part 273 of the rotating support hub 260 may be fixed to the side of the third groove 203 of the third divided plate 230, and the fourth rotating-support part 274 of the rotating support hub 260 may be fixed to the side of the fourth groove 204 of the fourth divided plate 240.

As shown in FIGS. 2 and 3, the first rotating-support part 271 of the rotating-support hub 260, the first upper fixing member 416 of the first driving actuator 410, and the second upper fixing member 426 of the second driving actuator 420 may be fixed on the first divided plate 210, respectively, so that their respective installed positions form the vertices of a triangle.

Similarly, the second rotating-support part 272 of the rotating-support hub 260, the third upper fixing member 436 of the third driving actuator 430, and the fourth upper fixing member 446 of the fourth driving actuator 440 may be fixed on the second divided plate 220, respectively, so that their respective installed positions form the vertices of a triangle. The third rotating-support part 273 of the rotating-support hub 260, the fifth upper fixing member 456 of the fifth driving actuator 450, and the sixth upper fixing member 466 of the sixth driving actuator 460 may be fixed on the third divided plate 230, respectively, so that their respective installed positions form the vertices of a triangle. The fourth rotating-support part 274 of the rotating-support hub 260, the seventh upper fixing member 476 of the seventh driving actuator 470, and the eighth upper fixing member 486 of the eighth driving actuator 480 may be fixed on the fourth divided plate 240, respectively, so that their respective installed positions form the vertices of a triangle.

As shown in FIGS. 2 and 3, the stage-terrain realization driver 400 may have a structure in which a plurality of triangles of which is connected with the position of the rotating-support part and the positions of the two driving actuators as vertices are arranged at a predetermined interval. The upper fixing member of each of the two driving actuators is fixed to a position of each of both vertices of each triangle, and the lower fixing member of each of the two driving actuators is fixed to the stage supporter 100*a*. Wherein the lower fixing member of each of the two driving actuators is fixed to the lower supporter by being inclined in a direction away from each other. In this state, as each of the two driving actuators extends and retracts in the longitudinal direction, an inclination of the divided plate corresponding to the two driving actuators may be implemented.

As the rotating-support part and the two driving actuators support each divided plate in a triangular structure and each driving actuator is installed at both vertices of the triangle in a predetermined inclined posture from the lower supporter to the divided swing-stage, each divided plate can stably perform the operation of the inclination. And, since each driving actuator is installed in an inclined state as described above, the installation height of the swing platform can be lowered.

The configuration of the above-described terrain realization driver 400 will be described in more detail. As shown in FIGS. 2 and 3, the stage supporter 100*a* is partitioned to a plurality of regions 110 to 150, etc., the rotating support hub 260 is provided in the central region 110, and two driving actuators are provided in each of the plurality of regions 120 to 150 around the central region 110 of the stage supporter 100*a*. The upper ends of the two driving actuators fixed in each region are provided inclined in a direction away from each other, and the upper end of one driving actuator in one region and the upper end of another driving actuator in another neighboring region are fixed to one divided plate. Accordingly, the inclination of the corresponding divided plate may be implemented by the longitudinal expansion and contraction driving of each of the two inclined driving actuators.

That is, as shown in FIGS. 2 and 3, the stage supporter 100*a* is partitioned to include the central region 110 and a plurality of regions (e.g., the first region 120, the second region 130, the third region 140, and the fourth region 150) around the central region 110. The rotating support hub 260 is fixedly installed in the central region 110. And the lower ends of the eighth driving actuator 480 and the first driving actuator 410 are installed adjacent to each other in the first region 120, the lower ends of the second driving actuator 420 and the third driving actuator 430 are installed adjacent to each other in the second region 130, the lower ends of the fourth driving actuator 440 and the fifth driving actuator 450 are installed adjacent to each other in the third region 140, and the lower ends of the sixth driving actuator 460 and the seventh driving actuator 470 are installed adjacent to each other in the fourth region 150. In such a state that each driving actuator is installed in the stage supporter 100*a*, the first driving actuator 410 and the second driving actuator 420 are fixed to the lower surface of the first divided plate 210 in an inclined posture, the third driving actuator 430 and the fourth driving actuator 440 are fixed to the lower surface of the second divided plate 220 in an inclined posture, the fifth driving actuator 450 and the sixth driving actuator 460 are fixed to the lower surface of the third divided plate 230 in an inclined posture, and the seventh driving actuator 470 and the eighth driving actuator 480 are fixed to the lower surface of the fourth divided plate 240 in an inclined posture.

A detailed configuration of each of the driving actuators 410 to 480 and the rotating support hub 260 will be described with reference to FIG. 4. FIG. 4(*a*) is a view showing the configuration of the driving actuator, and FIG. 4(*b*) is a view showing the configuration of the rotating support hub. (In FIG. 4(*a*), drawing numbers of the first driving actuator are given, however since all the driving actuators have the same configuration, when explaining FIG. 4(*a*), the "first" part will be omitted and explained).

Figure 4:
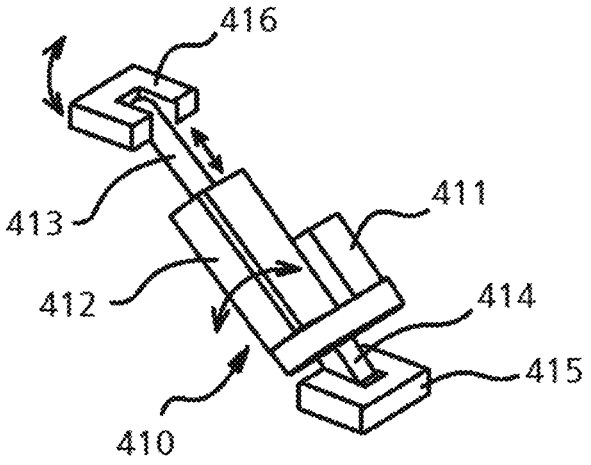
FIG. 4 is a view showing a driving actuator and a rotating-support hub of the stage-terrain realization driver shown in FIG. 2.
Figure 4:
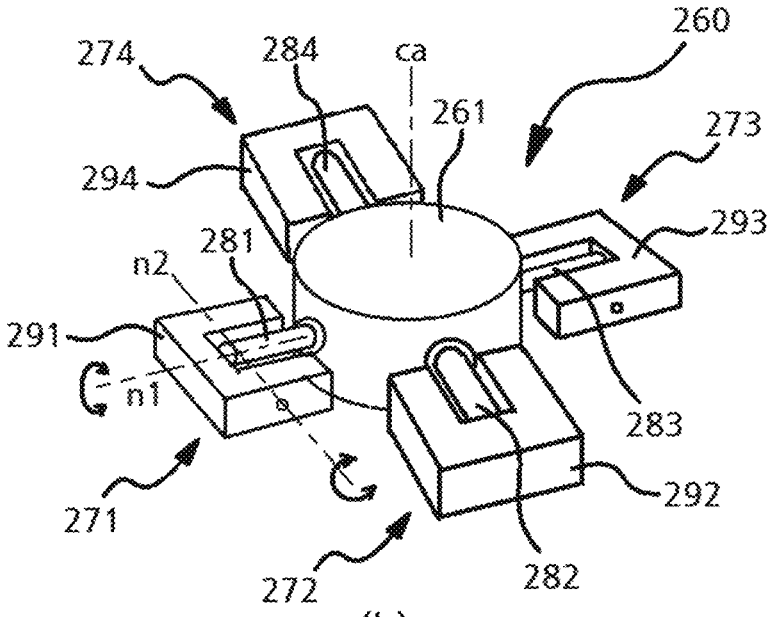

As shown in FIG. 4(*a*), the driving actuator 410 is configured to include a driving motor 411, a driving cylinder 412 operated by the driving motor 411, a rod 413 enabling to be extended and retracted in a linear direction according to the operation of the driving cylinder 412, a supporting shaft 414 protruding on the opposite side of the rod 413, a lower fixing member 415 to which the supporting shaft 414 is rotatably coupled and fixed on the lower supporter 100, and an upper fixing member 416 rotatably coupled to the rod 413 and fixed to the lower surface of the divided plate 210.

As the driving motor 411 rotates forward or reverse, the rod 413 of the driving cylinder 412 linearly moves in the longitudinal direction. As the rod 413 moves in the longitudinal direction, the driving actuator 410 rotates with respect to the lower fixing member 415 and the upper fixing member 416, respectively, and the inclination angle is changed.

As the two driving actuators 410 each operate as described above, the divided plate can implement various inclinations.

Meanwhile, as shown in FIG. 4(*b*), the rotating support hub 260 includes a hub shaft 261 provided at the center of the swing stage 200. The rotating support hub 260 may further include a first rotating-support part 271 which the first divided plate 210 supports to be rotatable about two axes n1 and n2 perpendicular to the central axis ca of the hub shaft, a second rotating support part 272 which the second divided plate 220 supports to be rotatable about two axes perpendicular to the central axis ca, a third rotating support part 273 which the third divided plate 230 supports to be rotatable about two axes perpendicular to the central axis ca, and a fourth rotating support part 274 which the fourth divided plate 240 supports to be rotatable about two axes perpendicular to the central axis ca.

As shown in FIG. 4(*b*), the first rotating-support part 271 is configured to include a first rotating-support shaft 281 which is rotatably (rotation around the n1 axis) provided to the hub shaft 261, and a first rotating-support fixer 291 which is rotatably (rotation around the n2 axis) provided to the first rotating-support shaft 281 and fixed to the first groove 201 of the first divided plate 210.

The configuration of the first rotating-support part 271 is substantially the same as that of the other rotating-support parts 272 to 274. That is, the second rotating-support part 272 is configured to include a second rotating-support shaft 282 which is rotatably provided to the hub shaft 261, and a second rotating-support fixer 292 which is rotatably provided to the second rotating-support shaft 282 and fixed to the second groove 202 of the second divided plate 220. And the third rotating-support part 273 is configured to include a third rotating-support shaft 283 which is rotatably provided to the hub shaft 261, and a third rotating-support fixer 293 which is rotatably provided to the third rotating-support shaft 283 and fixed to the third groove 203 of the third divided plate 230. And the fourth rotating-support part 274 is configured to include a fourth rotating-support shaft 284 which is rotatably provided to the hub shaft 261, and a fourth rotating-support fixer 294 which is rotatably provided to the fourth rotating-support shaft 284 and fixed to the fourth groove 204 of the fourth divided plate 240.

Meanwhile, the hub shaft 261 may be driven in the vertical direction by the hub driver 490 provided at the center of the stage supporter 100*a* (see FIG. 2).

Accordingly, each of the rotating-support parts may be fixed to the central portion of each divided plate to support each divided plate to be rotatable about the hub shaft in two directions. In this regard, it will be described with reference to FIG. 5.

Figure 5:
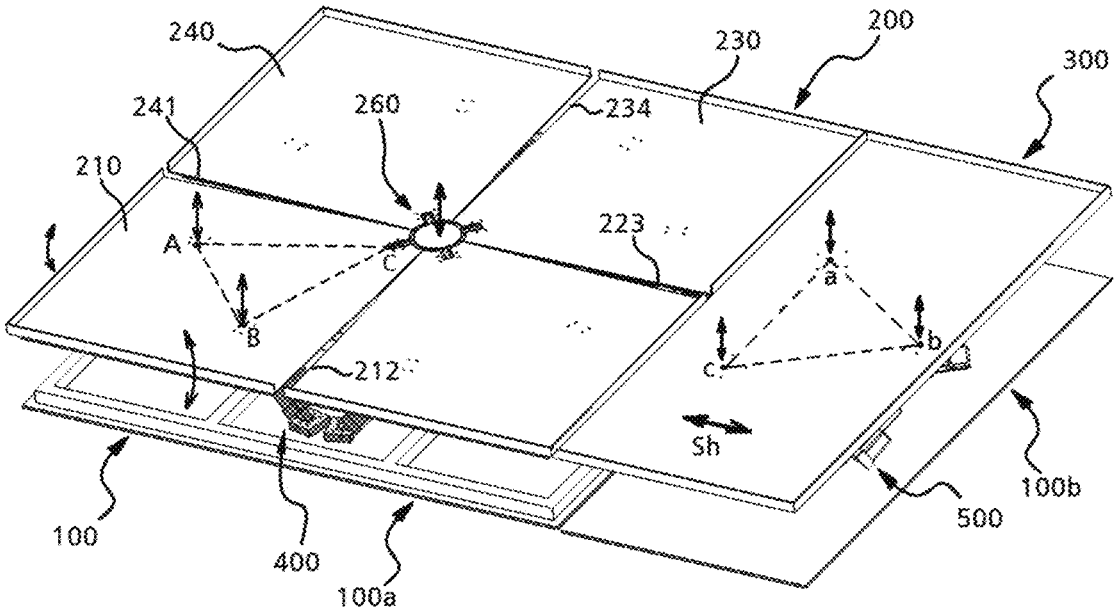
FIG. 5 is a view for explaining an operation of the golf swing platform according to an embodiment of the present invention.

As shown in FIG. 5, the first divided plate 210 has a support structure of a triangle connecting a support point C (a position where the first rotating-support part 271 is installed) on the side of the rotating-support hub 260, an action point A at which the upper end of the first driving actuator is fixed, and an action point B at which the upper end of the second driving actuator is fixed (This corresponds to the triangular structure that connects the first rotating-support part, the first driving actuator, and the second driving actuator shown in FIG. 3).

In accordance with the operation of the first driving actuator based on the support point C, the action point A part moves up and down to implement an inclination. Or in accordance with the operation of the second driving actuator, the inclination may be implemented as the action point B moves up and down. Or an inclination may be realized by simultaneous up-and-down movement at the action points A and B. In each of the above cases, as the hub driver 490 moves the hub shaft 261 in the vertical direction and the supporting point C moves in the vertical direction with movements at each of the points A and B, various inclinations of the divided plate can be implemented. The configuration and operation of the triangular support structure by the supporting point C, the action points A and B for the first divided plate 210 shown in FIG. 5 and the implementation of the inclination accordingly are substantially the same for other divided plates. Accordingly, the description of the other divided plates will be replaced with the description of the configuration and operation of the above stated the first divided plate, and the redundant description will be omitted.

Accordingly, the golf swing platform according to an embodiment of the present invention can implement various terrain by driving each of the divided plates 210 to 240 by the configuration as described above.

Meanwhile, as shown in FIGS. 2 and 5, triangular spacing parts 212, 223, 234, and 241 spaced apart from each other to be farther from the rotating-support hub 260 are formed between adjacent divided plates. By the triangular separation parts, it is possible to prevent two adjacent divided plates from interfering with each other, thereby implementing terrains with a stable and reliable operation.

Meanwhile, the configuration of the hitting-terrain realization driver 500 and the hitting stage 300 using the same will be described with reference to FIGS. 2 and 3.

As shown in FIGS. 2 and 3, a plurality of actuators 510 to 560 are fixedly installed on the hitting supporter 100*b* of the lower supporter 100 as the hitting-terrain realization driver 500.

That is, as shown in FIGS. 2 and 3, the first actuator 510 and the second actuator 520 may be disposed in a triangular shape to act at one point (referred to as an "action point a") on the hitting stage 300. And, the third actuator 530 and the fourth actuator 540 may be disposed in a triangular shape to act at another point (referred to as an "action point b") on the hitting stage 300. In addition, the fifth actuator 550 and the sixth actuator 560 may be disposed in a triangular shape to act at another point (referred to as an "action point c") on the hitting stage 300.

The above-described action points a, b, and c correspond to points on the hitting stage shown in FIG. 5.

That is, the hitting-terrain realization driver 500 is configured to have one end (upper end) of two actuators coupled to each of the action points (a, b, c) at each of the three vertex positions forming a triangle on the hitting stage 300, and each of the other ends (lower end) of the two actuators is configured to be coupled to positions separated from each other on the hitting supporter 100*b*. Accordingly, the action points a, b, and c of the hitting stage 300 are triangularly supported with respect to the hitting supporter 100*b*, and thus, the hitting stage 300 is inclined at the action points a, b, and c.

The specific configuration of each actuator may be substantially the same as the configuration of the driving actuator shown in FIG. 4(*a*).

The operation of the hitting stage 300 according to the driving of the hitting-terrain realization driver 500 as described above will be described with reference to FIG. 5. As described above, the action point a on the hitting stage 300 is a part where the upper end of the first actuator 510 and the upper end of the second actuator 520 simultaneously apply driving force. The action point b on the hitting stage 300 is a part where the upper end of the third actuator 530 and the upper end of the fourth actuator 540 simultaneously apply driving force. And the action point c on the hitting stage 300 is a part where the upper end of the fifth actuator 550 and the upper end of the sixth actuator 560 simultaneously apply driving force.

In this way, while driving force is applied by each actuator in the vertical direction on the action points a, b, and c, the inclination of the hitting stage 300 may be variously implemented.

In addition, according to the operation of the pairs of actuators as described above, the hitting stage 300 may be operated to shift Sh toward the swing stage 200.

Meanwhile, a control system of the golf swing platform according to an embodiment of the present invention will be described with reference to FIG. 6.

Figure 6:
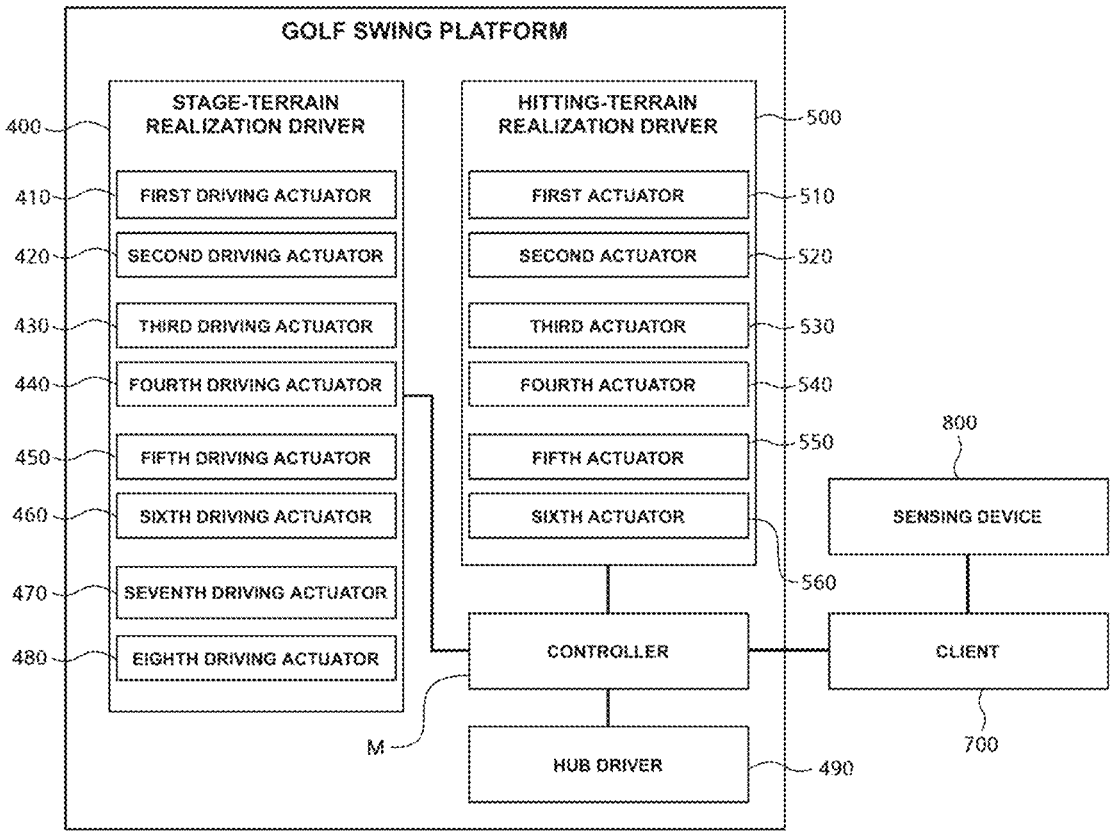
FIG. 6 is a block diagram showing a control system for a golf swing platform according to an embodiment of the present invention.

As shown in FIG. 6, the controller M of the golf swing platform is configured to control each of the actuators including the first driving actuator 410 and the second driving actuator 420, the third driving actuator 430 and the fourth driving actuator 440, the fifth driving actuator 450 and the sixth driving actuator 460, the seventh driving actuator 470 and the eighth driving actuator 480 of the stage-terrain realization driver 400. And the controller M is configured to control each of the actuators including the first actuator 510 and the second actuator 520, the third actuator 530 and the fourth actuator 540, the fifth actuator 550 and the sixth actuator 560 of the hitting-terrain realization driver 500, and the controller M is also configured to control the hub driver 490 that can drive the rotation support hub up and down.

The controller M may be configured to be communicatively connected with the client 700 of the virtual golf simulation apparatus to perform control in connection with each other.

The client 700 performs various data processing for virtual golf simulation using sensing information of the sensing device 800 that senses the ball hit by the user, and according to an embodiment, the controller M of the golf swing platform may also control each element using sensing information of the sensing device 800.

A method of implementing a slope in connection with terrain information of a virtual golf course by the golf swing platform according to an embodiment of the present invention having the above-described configuration will be described with reference to FIG. 7.

Figure 7:
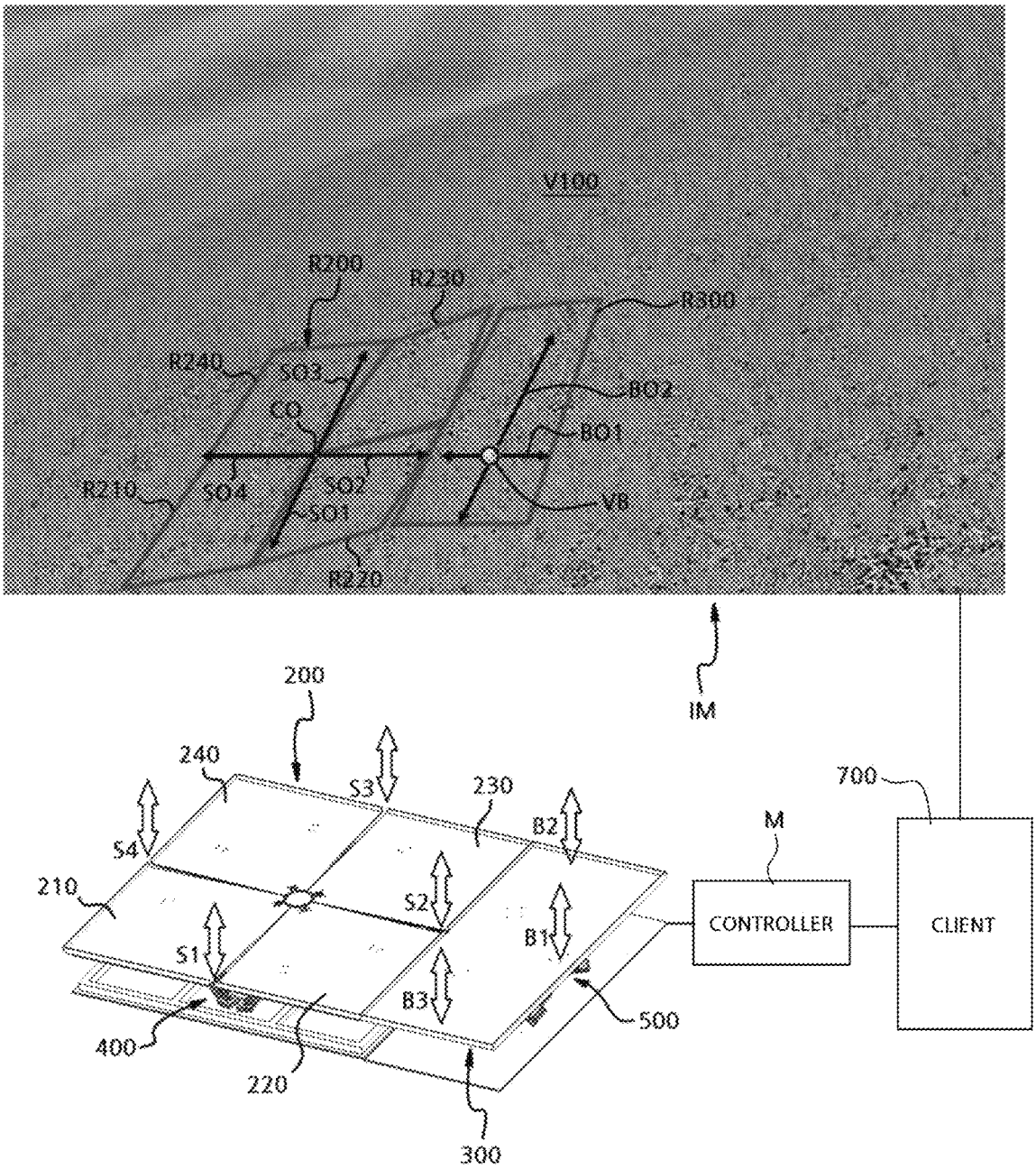
FIG. 7 is a view for explaining the calculation of inclination information for the golf swing platform and control of the inclination implementation accordingly according to an embodiment of the present invention.

As shown in FIG. 7, the controller of the golf swing platform according to an embodiment of the present invention controls the inclination of the hitting stage 300 and the swing stage 200 to be implemented in connection with the client 700 that implements an image (IM) of a virtual golf course (V100) and implements a simulation image of a virtual ball moving on a virtual golf course (V100) based on sensing information of a golf ball hit by a user. That is, the controller controls the stage-terrain realization driver 400 and the hitting-terrain realization driver 500 using inclination information of the hitting stage 300 and inclination information of the swing stage 200 calculated from terrain information of areas R200 and R300 corresponding to the swing stage and the hitting stage based on the position where the virtual ball VB is placed on the virtual golf course V100.

In FIG. 7, the virtual golf course V100 on the image IM has a wide range and is various, and among them, the hitting stage corresponding area R300 on the virtual golf course V100 corresponding to the hitting stage 300 is specified based on the position where the virtual ball VB is placed. In the virtual golf course, the inclination in the horizontal axis direction BO1 (a first inclination of the hitting stage) and the inclination in the vertical axis direction BO2 (a second inclination of the hitting stage) are calculated based on the terrain information of the hitting stage corresponding area R300 with the position of the virtual ball VB as the origin. In addition, the controller can control the hitting-terrain realization driver 500 so that the inclination of the hitting stage 300 can be adjusted according to the calculated the first inclination of the hitting stage and the second inclination of the hitting stage.

The inclination in the horizontal axis direction BO1 may be determined using a difference between two set coordinate values in the horizontal axis direction with respect to the origin. (For example, the coordinate value in the right direction and the coordinate value in the left direction may be set to correspond to each other based on the origin). The inclination in the vertical axis direction BO2 may be determined using a difference between two set coordinate values in the vertical axis direction with respect to the origin. (For example, the upper coordinate value and the lower coordinate value may be set to correspond to each other based on the origin).

When calculating the inclination in the horizontal axis direction BO1 and the inclination in the vertical axis direction BO2 based on the position of the virtual ball VB as an origin, a relative coordinate system with the horizontal axis direction as an x-axis, a vertical axis direction as a y-axis, and a vertical upper direction as a z-axis may be defined, and the calculation of the above stated inclinations may be easily calculated using the relative coordinate system.

Using information on an inclination calculated from the inclination in the horizontal axis direction BO1 based on the position the virtual ball VB as an origin (the first inclination of the hitting stage), the corresponding inclination of the hitting stage 300 can be implemented by controlling up and down driving at B1 position on the hitting stage 300. And using information on an inclination calculated from the inclination in the vertical axis direction BO2 based on the position the virtual ball VB as an origin (the second inclination of the hitting stage), the corresponding inclination of the hitting stage 300 can be implemented by controlling up and down driving at B2 position and/or B3 position on the hitting stage 300.

The calculation of the inclinations may be performed by the client, and the controller M controls the hitting-terrain realization driver 500 according to the calculated inclination value. Alternatively, the controller M may perform all of the above-described inclination calculation to the control of the hitting-terrain realization driver 500 according to the inclination value. Alternatively, it is possible to configure the client 700 to perform the role of the controller M together.

The implementation of the inclination of the hitting stage 300 according to the inclination information as described above will be described in connection with FIG. 5. For example, if the inclination in the horizontal axis direction BO1 (first inclination of the hitting stage) is inclined downward, the corresponding inclination can be implemented so that the position B1 on the hitting stage 300 shown in FIG. 7 goes down by controlling that the action points a and b are maintained as they are and the action point c part is driven downward shown in FIG. 5.

For example, if the inclination in the vertical axis direction BO2 (second inclination of the hitting stage) is an inclination which the front is inclined downward, the corresponding inclination can be implemented so that the position B2 on the hitting stage 300 shown in FIG. 7 goes down by controlling that the action point a part is driven downward shown in FIG. 5.

In another embodiment, in specifying the hitting stage corresponding area R300 shown in FIG. 7, the hitting stage corresponding area R300 may be specified based on the position of a real golf ball actually placed on the hitting stage 300.

That is, it is possible to specify a position where the virtual ball VB is placed on the hitting stage corresponding area R300 so as to correspond to the position of the golf ball placed on the actual hitting stage 300. It is possible to specify the hitting stage corresponding area R300 using the position detection information of the golf ball on the hitting stage 300 sensed by a sensing device (not shown), a virtual ball placed on the virtual golf course V100 so as to correspond to the position of the real golf ball placed on the hitting stage by positioning the virtual ball VB on the hitting stage corresponding area R300.

Meanwhile, the controller M and/or the client 700 may know information for specifying the regions of the hitting stage 300 and the swing stage 200 in real space (e.g., position information of each vertex of the hitting stage 300 and the swing stage 200) and may also know position information of the real golf ball by sensing information of the sensing device. Therefore, using the above information, the origin coordinate CO of the swing stage corresponding area R200 (coordinate of the center point of the swing stage corresponding area R200) may be calculated based on the position of the virtual ball VB on the virtual golf course V100.

In addition, a coordinate point at an arbitrary position spaced apart by a preset distance based on a coordinate value of the virtual ball VB located in the hitting stage corresponding area R300 may be set as an origin coordinate CO of the swing stage corresponding area R200.

As described above, the origin coordinates CO of the swing stage corresponding area R200 can be obtained by calculating to correspond to the distance between the actual golf ball and the center of the swing stage, or it can be calculated using a predetermined distance value as a distance from the position of the virtual ball VB to the origin CO.

As described above, after calculating the coordinates of the origin CO of the swing stage corresponding area R200, the swing stage corresponding area R200 can be specified to correspond to the known region of the swing stage based on the calculated coordinates of the origin CO. In this case, the swing stage corresponding area R200 may be specified to be divided into an area R210 corresponding to the first divided plate 210, an area R220 corresponding to the second divided plate 220, an area R230 corresponding to the third divided plate 230, and an area R240 corresponding to the fourth divided plate 240. Alternatively, an area corresponding to the entire region of the swing stage may be specified as the swing stage corresponding area R200.

As described above, the controller M and/or the client 700 calculates the origin coordinates CO of the swing stage corresponding area R200, and calculate the horizontal axis Inclination in the left direction SO4 (the fourth swing stage inclination), the horizontal axis inclination in the right direction SO2 (the second swing stage inclination), and the inclination of the vertical axis forward direction SO3 (the third swing stage inclination) and the inclination of the vertical axis backward direction SO1 (the fourth swing state inclination) based on the terrain information of the swing stage corresponding area R200.

Further, the controller M may control the inclination by driving a height between the first divided plate 210 and the second divided plate 220 to correspond to the inclination (the first swing stage inclination) of the vertical axis in the backward direction SO1 (driving the height of the position S1). Also, the controller may control the inclination by driving a height between the second divided plate 220 and the third divided plate 230 corresponding to the inclination (the second swing stage inclination) of the horizontal axis in the right direction (driving the height of the position S2). Also, the controller may control the inclination by driving a height between the third divided plate 230 and the fourth divided plate 240 corresponding to the inclination (the third swing stage inclination) of the vertical axis in the forward direction (driving the height of the position S3). Also, the controller may control the inclination by driving the height between the fourth divided plate 240 and the first divided plate 210 corresponding to the inclination (the fourth swing stage inclination) of the horizontal axis in the left direction (driving the height of the position S4). As described above, the inclination implementation of the swing stage 200 may be controlled by the height driving of each of the positions.

When calculating the inclination of the first to fourth swing stage as described above, the calculation of the inclination may be facilitated by defining a relative coordinate system with a horizontal axis as an x' axis, a vertical axis as a y' axis, and a vertical upper direction as a z' axis based on a position of the origin CO of the swing stage corresponding area.

In the above-described manner, the inclination implementation of the swing stage 200 of the golf swing platform by each divided plate and the inclination implementation of the hitting stage 300 may be quite similar to terrain information of a position where a virtual ball is placed on a virtual golf course. Therefore, since the user can take a golf shot on the golf swing platform inclined quite similar to the terrain of a position where the virtual ball is placed on the virtual golf course, the user can take a golf shot in a more dynamic environment than before.

Figure 8:
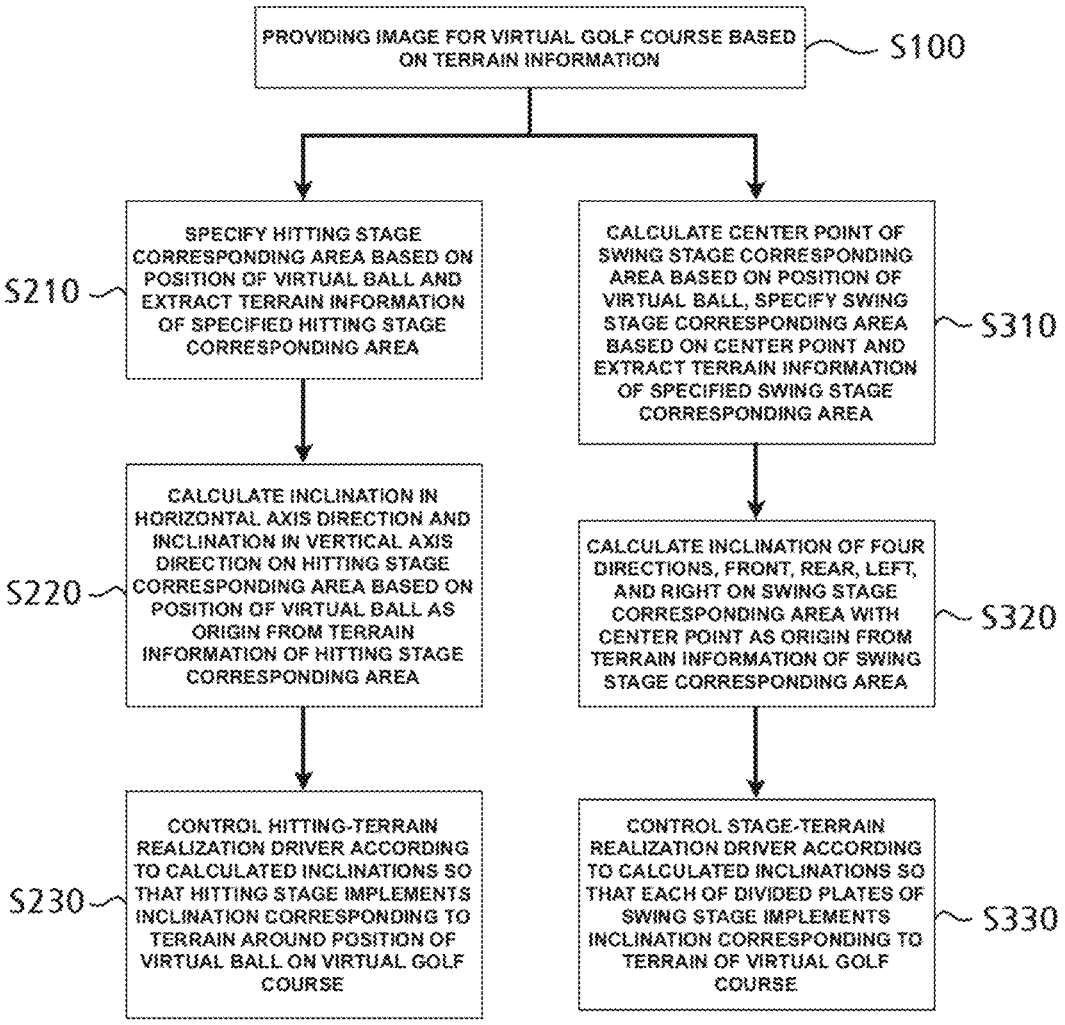
FIG. 8 is a flowchart showing a control method of a golf swing platform according to an embodiment of the present invention.

Meanwhile, the contents of the method of controlling the golf swing platform according to an embodiment of the present invention are all included in the above description, however will be briefly described again using the flowchart shown in FIG. 8.

As golf practice or virtual golf round using the virtual golf simulation apparatus starts, the client implements an image of a virtual golf course based on terrain information stored in the data storage in step S100.

The client may specify a hitting stage corresponding area based on a position of a virtual ball placed on the virtual golf course and extract terrain information of the specified hitting stage corresponding area in step S210.

The client may calculate the origin of the swing stage corresponding area based on the position of the virtual ball placed on the virtual golf course, specify the swing stage corresponding area based on the origin, and extract terrain information of the specified swing stage corresponding area in step S310.

As described above, the hitting stage corresponding area and the swing stage corresponding area may be obtained by specifying areas on the virtual golf course corresponding to the area corresponding to the hitting stage and the area corresponding to the swing stage, and the hitting stage corresponding area and the swing stage corresponding area may be specified by corresponding to the position of the virtual ball to the actual position of the golf ball.

Meanwhile, from the terrain information of the hitting stage corresponding area extracted in step S210, the client or controller may calculate an inclination in the horizontal axis direction and an inclination in the vertical axis direction on the hitting stage corresponding area based on the position of the virtual ball in step S220.

And, from the terrain information of the swing stage corresponding area extracted in step S310, the client or controller may calculate an origin on the hitting stage corresponding area and calculate inclinations in four directions, front, rear, left, and right, respectively in step S320.

According to each inclination calculated in step S220, the controller may control the hitting-terrain realization driver so that the hitting stage of the golf swing platform may implement the inclination according to the terrain around the virtual ball position of the virtual golf course in step S230.

And according to each inclination calculated in step S320, the controller may control the stage-terrain realization driver to implement the inclinations according to the terrain of the virtual golf course of each divided plate of the golf swing platform in step S330.

As described above, by the method of controlling the golf swing platform according to an embodiment of the present invention, the inclination implementation of the swing stage 200 by each divided plate and the inclination implementation of the hitting stage 300 may be significantly similar to terrain information of a position where a virtual ball is placed on the virtual golf course.

Meanwhile, as described above, in the process of implementing the inclination of the swing stage and the hitting stage, a case where the swing stage and the hitting stage are spaced may occur.

Figure 9:
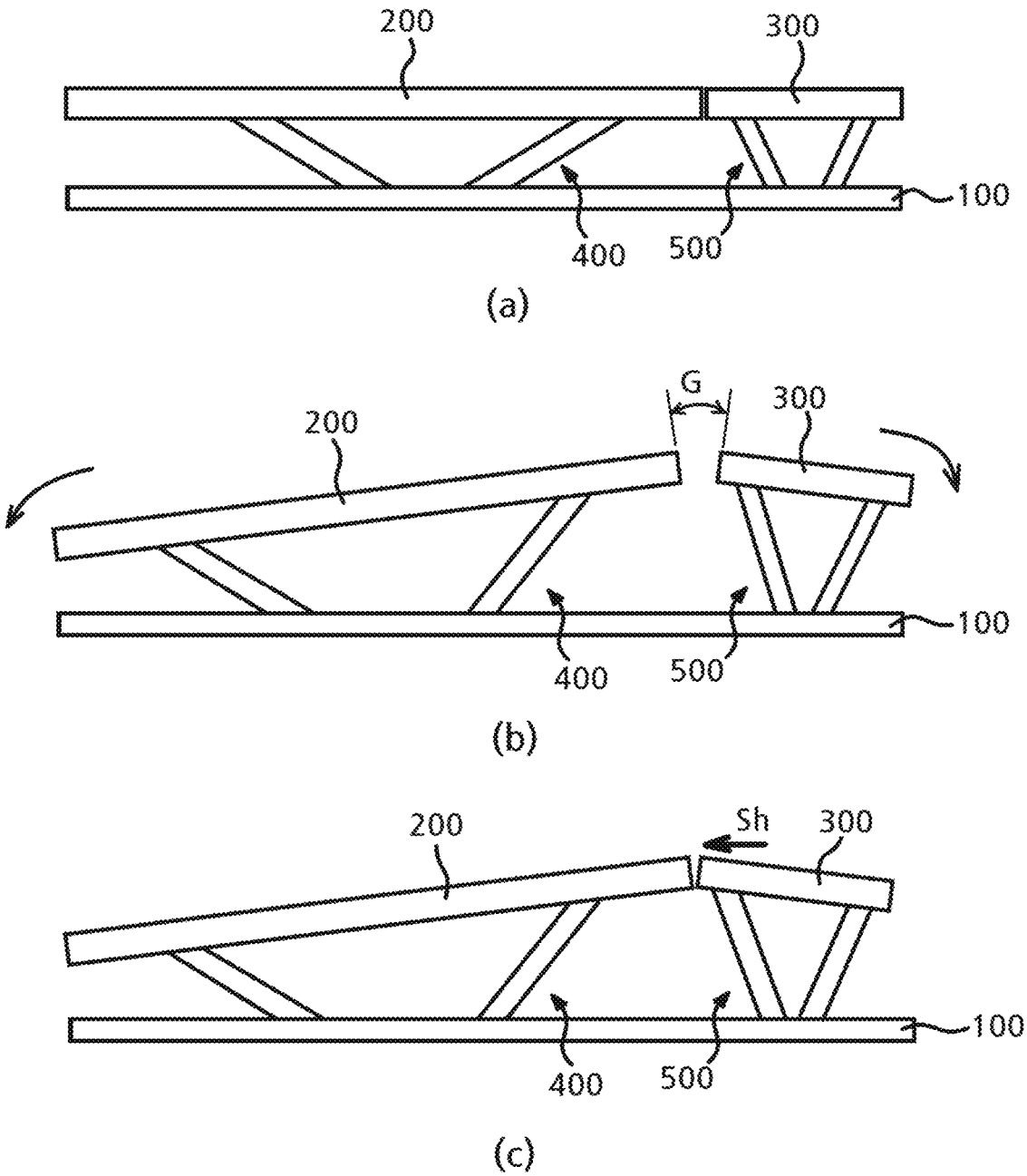
FIG. 9 is a view for explaining the generation of a gap between the divided swing stage and the hitting stage of the golf swing platform according to an embodiment of the present invention and control for preventing the gap.

That is, as shown in FIG. 9(*a*), in a state where the swing stage 200 and the hitting stage 300 of the golf swing platform do not implement the inclination, according to the inclination of the swing stage 200 and the hitting stage 300 is implemented as the inclination information at each position is calculated in connection with the terrain information of the virtual golf course, as shown in FIG. 9(*b*), a gap G between the swing stage 200 and the hitting stage 300 may occur.

The controller may preset information on a case in which the gap G occurs according to control information of the driving actuators and actuators constituting the stage-terrain realization driver 400 and the hitting-terrain realization driver 500. And the controller may control the hitting-terrain realization driver 500 so that the gap G does not occur based on the preset information so that the hitting stage 300 shifts toward the swing stage 200.

That is, as shown in FIG. 9(*b*), when the controller implements the inclination of the swing stage 200 and the hitting stage 300 according to the control information for implementing the inclination, it is determined whether a gap G occurs between the swing stage 200 and the hitting stage 300, and when the gap G occurs, as shown in FIG. 9(*c*), the gap G may not occur by controlling the hitting-terrain realization driver 500 to generate the shift Sh.

That is, when the information on each inclination of the swing stage is information within the range in which the gap G may occur as described above, the control information on the shift Sh may be included in the original control information to control the drivers. Alternatively, after the gap G occurs, the controller may determine whether the gap G occurs and control the shift Sh to be performed.

The golf swing platform may perform a stable and reliable operation by controlling the shift Sh of the hitting stage 300.

INDUSTRIAL APPLICABILITY

The golf swing platform according to the present invention may be used in an industrial field related to golf practice and a so-called screen golf industry field in which golf play may be enjoyed based on a virtual golf simulation.

The invention claimed is:

1. A golf swing platform on which a user takes a golf swing with a golf club, comprising:

a lower supporter including a stage supporter and a hitting supporter;

a hitting stage which is provided on the hitting supporter of the lower supporter so that a golf ball is placed thereon for the user's golf shot and implements an inclination based on terrain information;

a swing stage which is provided on the stage supporter of the lower supporter so that a user stands thereon for the golf swing and implements the inclination based on the terrain information, along with the hitting stage;

a stage-terrain realization driver which is provided between the swing stage and the stage supporter, and drives the swing stage to implement the inclination;

a hitting-terrain realization driver which is provided between the hitting stage and the hitting supporter, and drives the hitting stage to implement the inclination; and a controller configured to:

provide an image of a virtual golf course in which a virtual ball moves according to the user's hitting of the golf ball;

specify an area in the virtual golf course corresponding to the swing stage and an area in the virtual golf course corresponding to the hitting stage, based on a position of the virtual ball in the virtual golf course;

calculate inclination information of the swing stage and inclination information of the hitting stage from terrain information of the specified area corresponding to the swing stage and the specified area corresponding to the hitting stage; and independently control the hitting-terrain realization driver and the stage-terrain realization driver to drive the hitting and swing stages so as to implement inclinations of the hitting and swing stages according to the inclination information of the hitting and swing stages, respectively, wherein the swing stage is configured to be divided into a plurality of divided plates each of which is provided to implement an inclination according to terrain information so that the swing stage enables implementation of complex inclinations, wherein the specifying of the areas in the virtual golf course includes specifying a swing stage corresponding area that is the area corresponding to the swing stage based on the position of the virtual ball in the virtual golf course, wherein the calculating of the inclination information of the swing stage includes calculating of:

a first inclination of the swing stage that is an inclination of a backward direction in a vertical axis; a second inclination of the swing stage that is an inclination in a right direction of a horizontal axis; a third inclination of the swing stage that is an inclination in a left direction of the horizontal axis; and a fourth inclination of the swing stage that is an inclination of a forward direction in the vertical axis based on a center point of the swing stage corresponding area as an origin, and wherein the controlling of the stage-terrain realization driver includes controlling the stage-terrain realization driver so that the inclination of each of the divided plates of the swing stage is adjusted according to the calculated first, the second, the third and the fourth inclinations of the swing stage.

2. The golf swing platform according to claim 1, wherein the swing stage includes a plurality of divided plates each implementing an inclination, based on the terrain information so that the swing stage implements complex inclinations corresponding to the terrain information.

3. The golf swing platform according to claim 2, wherein the swing stage includes a rotating-support hub provided in a central portion of the swing stage and supporting each end of the plurality of divided plates to be rotatable in relation to the two-axis direction, wherein the plurality of divided plates are divided around the rotating-support hub so that each of the divided plates is configured to implement the inclination.

4. The golf swing platform according to claim 1, wherein the hitting-terrain realization driver is configured to implement an inclination of the hitting stage in a direction perpendicular to a horizontal axis and an inclination of the hitting stage in a direction perpendicular to a vertical axis, and drive the hitting stage to be shifted toward the swing stage.

5. The golf swing platform according to claim 1, wherein the hitting-terrain realization driver includes a plurality of actuators, wherein each of three vertex positions forming a triangle on the hitting stage is an action point, ends of the two actuators are coupled to each action point, and each of the other ends of the two actuators is coupled to positions spaced apart from each other on the hitting supporter, and wherein each of the action points on the hitting stage is triangularly supported with respect to the hitting supporter by combinations of the actuators, and implementation of the inclination of the hitting stage is performed based on each operating point.

6. The golf swing platform according to claim 1, wherein the controller is configured to control implementation of a simulation image in which the virtual ball moves on the virtual golf course based on sensing information of a sensing device for the golf ball hit by the user, and wherein a position of the golf ball on the hitting stage sensed by the sensing device corresponds to the position of the virtual ball on the virtual golf course, and an area on the virtual golf course corresponding to an area of the swing stage and the hitting stage is specified based on the position of the virtual ball.

7. The golf swing platform according to claim 1, wherein the controller is configured to set the position of the virtual ball on the virtual golf course as an origin based on which the controller specifies a hitting stage corresponding area that is the area corresponding to the hitting stage, wherein the controller is configured to set a position by a predetermined distance on the virtual golf course based on the position of the virtual ball as an origin based on which the controller specifies a swing stage corresponding area that is the area corresponding to the swing stage, and wherein the controller is configured to calculate an inclination in a horizontal direction and an inclination in a vertical direction based on each of the set origin points, and control the inclinations of the hitting stage and the swing stage according to the calculated inclination in each of the two directions.

8. The golf swing platform according to claim 1, wherein the swing stage is configured to be divided into a plurality of divided plates each of which is provided to implement a predetermined inclination, wherein the controller is configured to specify a swing stage corresponding area that is the area corresponding to the swing stage based on the position of the virtual ball in the virtual golf course, and calculate an inclination toward a left direction in a horizontal axis, an inclination toward a right direction in the horizontal axis, an inclination forward in a vertical axis and an inclination backward in the vertical axis based on an origin set on the swing stage corresponding area, and wherein the controller is configured to control the inclination of the swing stage by driving a height between adjacent divided plates among the plurality of divided plates to correspond to the inclination toward the left direction in the horizontal axis.

9. A control method of a golf swing platform comprising:

providing an image of a virtual golf course in which a virtual ball moves according to a user's hitting of a golf ball;

specifying an area in the virtual golf course corresponding to a swing stage on which a user stands for the golf swing and an area in the virtual golf course corresponding to a hitting stage on which a golf ball is placed for the user's golf shot, based on a position of the virtual ball on the virtual golf course;

calculating inclination information of the swing stage and inclination information of the hitting stage from terrain information of the specified area corresponding to the swing stage and the specified area corresponding to the hitting stage;

controlling a hitting-terrain realization driver to drive the hitting stage so as to implement an inclination of the hitting stage according to the calculated inclination information of the hitting stage; and controlling a stage-terrain realization driver to drive the swing stage so as to implement an inclination of the swing stage according to the calculated inclination information of the swing stage, wherein the swing stage is configured to be divided into a plurality of divided plates each of which is provided to implement an inclination according to terrain information so that the swing stage enables implementation of complex inclinations, wherein the specifying of the areas in the virtual golf course includes specifying a swing stage corresponding area that is the area corresponding to the swing stage based on the position of the virtual ball in the virtual golf course, wherein the calculating of the inclination information of the swing stage includes calculating of:

a first inclination of the swing stage that is an inclination of a backward direction in a vertical axis; a second inclination of the swing stage that is an inclination in a right direction of a horizontal axis; a third inclination of the swing stage that is an inclination in a left direction of the horizontal axis; and a fourth inclination of the swing stage that is an inclination of a forward direction in the vertical axis based on a center point of the swing stage corresponding area as an origin, and wherein the controlling of the stage-terrain realization driver includes controlling the stage-terrain realization driver so that the inclination of each of the divided plates of the swing stage is adjusted according to the calculated first, the second, the third and the fourth inclinations of the swing stage.

10. The control method of the golf swing platform according to claim 9, wherein the specifying of the areas in the virtual golf course includes specifying a hitting stage corresponding area that is the area corresponding to the hitting stage based on the position of the virtual ball in the virtual golf course, wherein the calculating of the inclination information of the hitting stage includes calculating a first inclination of the hitting stage that is an inclination in a direction of a horizontal axis and a second inclination of the hitting stage that is an inclination in a direction of a vertical axis based on the position of the virtual ball as an origin, and wherein the controlling of the hitting-terrain realization driver includes controlling the hitting-terrain realization driver so that the inclination of the hitting stage is adjusted according to the calculated first and the second inclinations of the hitting stage.

11. A control method of a golf swing platform comprising:

providing an image of a virtual golf course in which a virtual ball moves according to a user's hitting of a golf ball;

specifying an area in the virtual golf course corresponding to a swing stage on which a user stands for the golf swing and an area in the virtual golf course corresponding to a hitting stage on which a golf ball is placed for the user's golf shot, based on a position of the virtual ball on the virtual golf course;

calculating inclination information of the swing stage and inclination information of the hitting stage from terrain information of the specified area corresponding to the swing stage and the specified area corresponding to the hitting stage;

controlling a hitting-terrain realization driver to drive the hitting stage so as to implement an inclination of the hitting stage according to the calculated inclination information of the hitting stage; and controlling a stage-terrain realization driver to drive the swing stage so as to implement an inclination of the swing stage according to the calculated inclination information of the swing stage, wherein the controlling of the hitting-terrain realization driver includes:

determining to generate a predetermined gap between the swing stage and the hitting stage according to information calculated in the calculating of the inclination information of the swing stage and the inclination information of the hitting stage; and controlling the hitting-terrain realization driver so that the hitting stage shifts toward the swing stage when the predetermined gap between the swing stage and the hitting stage is generated.

* * * * *